US009004454B1

(12) United States Patent
Faure et al.

(10) Patent No.: US 9,004,454 B1
(45) Date of Patent: Apr. 14, 2015

(54) CONTAINER LIFT AND LEVELING SYSTEM

(71) Applicant: U.S. Army Research Development and Engineering Command, APG, MD (US)

(72) Inventors: Luis Enrique Faure, Abingdon, MD (US); George J. Noya, Bel Air, MD (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 230 days.

(21) Appl. No.: 13/782,247

(22) Filed: Mar. 1, 2013

Related U.S. Application Data

(60) Provisional application No. 61/625,769, filed on Apr. 18, 2012.

(51) Int. Cl.
*B66F 3/46* (2006.01)
*B65D 90/00* (2006.01)

(52) U.S. Cl.
CPC ..... *B65D 90/0033* (2013.01)

(58) Field of Classification Search
CPC ..... B60S 9/205; B60S 9/00; B66F 7/20; B66F 7/28; B66F 11/00
USPC ..... 254/93 VA, 93 L, 93 A, 89 H, 92, 10 C, 254/9 C, 49, 50, 8 C, 418–425; 403/83, 91, 403/99, 101, 106; 187/343, 344, 359, 360, 187/362, 363, 364, 366, 367, 379
See application file for complete search history.

(56) References Cited

U.S. PATENT DOCUMENTS

| | | | | | |
|---|---|---|---|---|---|
| 2,937,879 | A * | 5/1960 | Lion | 280/43.21 |
| 2,985,482 | A * | 5/1961 | Lion | 220/1.5 |
| 3,773,199 | A * | 11/1973 | Arvidsson | 414/498 |
| 3,874,029 | A * | 4/1975 | McCullough | 16/329 |
| 4,176,391 | A * | 11/1979 | Kulik et al. | 362/390 |
| 4,193,695 | A * | 3/1980 | Kojima et al. | 356/418 |
| 4,455,711 | A * | 6/1984 | Anderson | 16/229 |
| 4,570,290 | A * | 2/1986 | Anderson | 16/229 |
| 4,743,037 | A * | 5/1988 | Hanser | 280/6.153 |
| 4,903,946 | A * | 2/1990 | Stark | 254/45 |
| 6,050,573 | A * | 4/2000 | Kunz | 280/6.153 |
| 6,317,928 | B1 * | 11/2001 | Guillemette | 16/353 |
| 6,584,385 | B1 * | 6/2003 | Ford et al. | 701/36 |
| 6,913,248 | B1 * | 7/2005 | Schmitz | 254/423 |
| 7,025,178 | B2 * | 4/2006 | Wengelski et al. | 187/277 |
| 7,150,073 | B2 * | 12/2006 | Stewart | 16/354 |
| 7,189,046 | B2 * | 3/2007 | Gehring et al. | 414/198 |
| 7,219,770 | B2 * | 5/2007 | Baker | 187/247 |
| 7,294,797 | B2 * | 11/2007 | Erickson | 200/18 |

(Continued)

*Primary Examiner* — Joseph J Hail
*Assistant Examiner* — Jon Taylor
(74) *Attorney, Agent, or Firm* — Ulysses John Biffoni

(57) ABSTRACT

A system for vertically lifting and lowering a container relative to a supporting surface. The system includes at least two lift mechanisms wherein each mechanism includes a frame attached to the container. An elongated cylinder and piston is associated with each frame so that its axis is substantially vertical. A control circuit selectively connects a power source to each cylinder and piston to move the cylinder and piston between a retracted position in which the piston is spaced upwardly from the supporting surface and an extended position in which a foot on the piston engages the supporting surface and lifts the container upwardly from the supporting surface.

9 Claims, 3 Drawing Sheets

(56) References Cited

U.S. PATENT DOCUMENTS 7,322,629 B2 * 1/2008 McClintock ..... 296/37.14
7,407,189 B2 * 8/2008 Hiebert et al. ..... 280/766.1
8,272,623 B2 * 9/2012 Draxl et al. ..... 254/45

* cited by examiner

CONTAINER LIFT AND LEVELING SYSTEM

RELATED APPLICATIONS

This application claims the benefit of priority of provisional application Ser. No. 61/625,769 filed on Apr. 18, 2012.

GOVERNMENT INTEREST

The invention described herein may be manufactured, used, and licensed by or for the United States Government.

BACKGROUND OF THE INVENTION

I. Field of the Invention

The present invention relates to a lift and leveling system for a shipping container.

II. Description of Related Art

Shipping containers are widely used to ship goods of all sorts throughout the world. These shipping containers typically are rectangular in shape and standardized in size. As such, these containers fit on a wide variety of transport devices, such as boats, trains, and trucks.

The shipping containers are oftentimes temporarily stored on a ground support surface. Consequently, in order to position the shipping container on a flatbed truck, it is often necessary to bring in additional equipment in order to lift the container onto the flatbed truck. For example, a crane or forklift is oftentimes used to lift the container onto a flatbed truck.

Unfortunately, the loading equipment, e.g. a crane or forklift truck, may not be readily available when needed to load the container onto the flatbed truck which introduces additional delays in the shipment of the goods. Furthermore, the operation of such lifting equipment requires specialized and highly trained personnel. Such personnel may not be readily available and, if available, add to the overall cost of transporting the container with its cargo.

In addition to shipping cargo, such containers are oftentimes used by the military and others for specialized purposes, such as a mobile laboratory or mobile communication unit. In such cases, it is oftentimes necessary to protect the container against impacts which may damage such mobile devices. Unfortunately, careful handling of the container and the avoidance of such impacts with the use of cranes and forklift trucks is oftentimes difficult to achieve. Consequently, such mobile devices are oftentimes damaged in the process of loading the container onto a flatbed truck.

SUMMARY OF THE PRESENT INVENTION

The present invention provides a container lift and leveling system that overcomes all of the above-mentioned disadvantages of the previously known containers.

In brief, the system of the present invention includes at least two lift mechanisms. Each mechanism has a frame which is attached to the container. Preferably, four lift mechanisms are attached to each container with one lift mechanism positioned adjacent each corner of the container.

An elongated cylinder and piston is associated with and attached to each frame. The cylinder and piston are oriented so that a longitudinal axis of the piston and cylinder extends in a generally vertical direction with the cylinder above the piston. A foot is attached to the distal or free end of the piston.

Each frame is pivotally mounted between an upper and a lower support block to the container so that the frame is pivotal between a storage position and an operational position. In its storage position, the frame nests closely adjacent the container. Conversely, in its operational position, the frame with its associated piston and cylinder is spaced outwardly from the container.

A control circuit selectively powers the cylinder and pistons on the lift mechanisms to bring the container to a level position and/or to an elevated position for loading the container onto or off from a truck. A two axis level sensor provides an input signal to the control circuit to facilitate the leveling of the container.

Since the entire level and lifting system of the present invention is self-contained with the container, the use of additional equipment such as a crane or forklift is unnecessary to both load the container onto a flatbed truck, as well as to remove the container from a flatbed truck.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
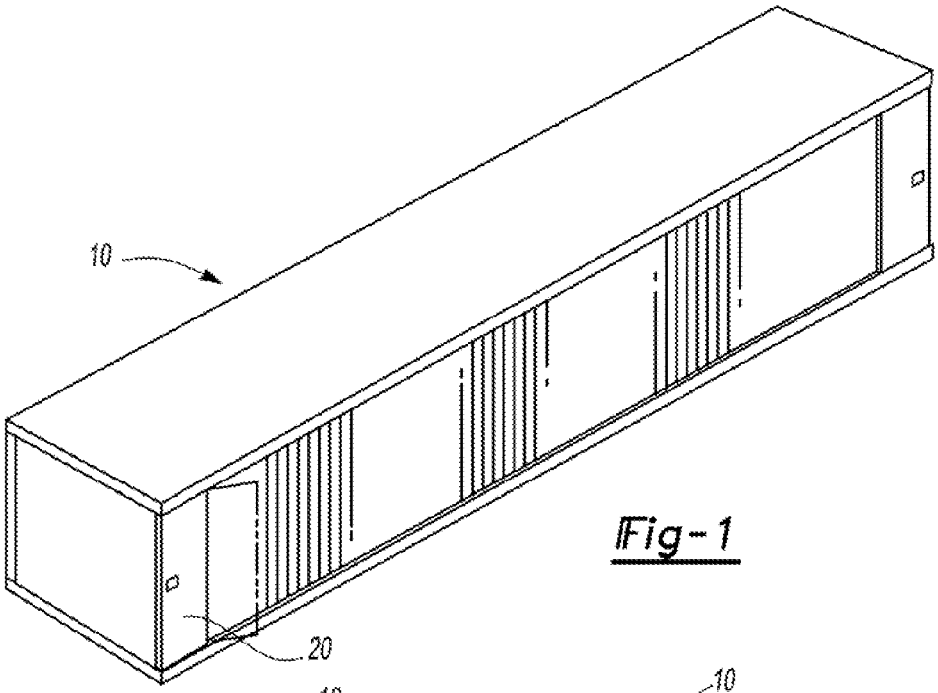
FIG. 1 is an elevational view illustrating a container with the leveling and lifting system of the present invention.

With reference first to FIG. 1, a standard cargo container 10 is shown. The cargo container 10 is generally rectangular in shape. Furthermore, the container 10 is preferably of conventional size and, as such, usable on boats, trains, flatbed trucks, and the like.

Figure 2:
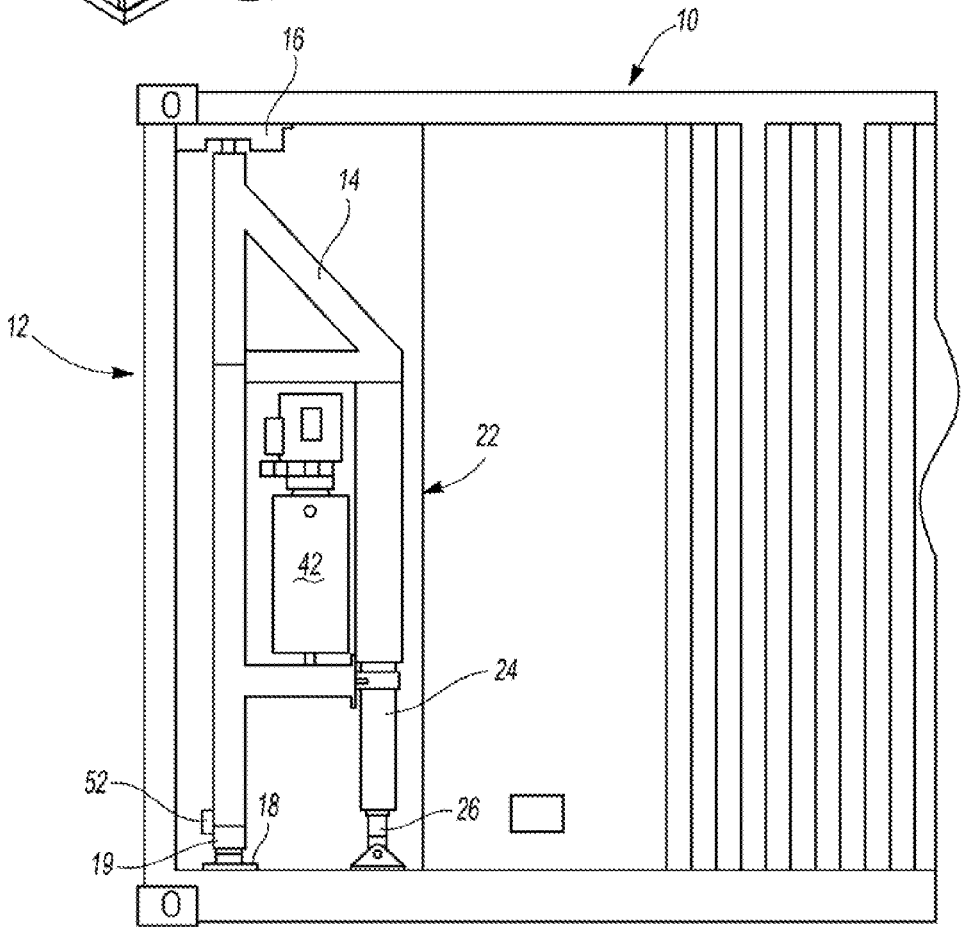
FIG. 2 is as side view illustrating a preferred embodiment of one lift mechanism for the present invention in the storage position.
Figure 3:
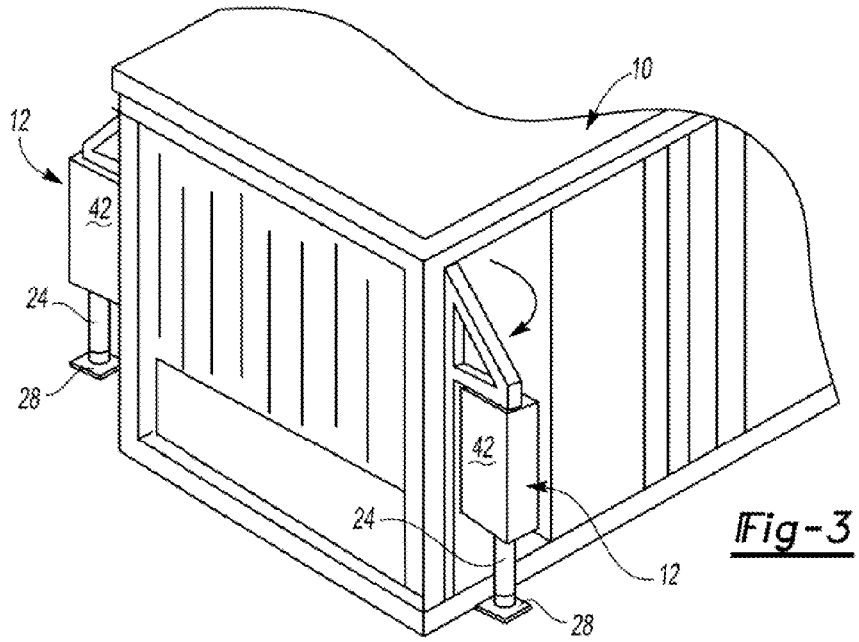
FIG. 3 is a view similar to FIG. 2, but illustrating the lift mechanism in an operational position.

With reference now to FIGS. 2-3, a lift mechanism 12 is associated with each corner of the container 10. The lift mechanism 12 includes a frame 14 which is pivotally mounted about a vertical axis between an upper support block 16 and a lower support block 18. The support blocks 16 are fixedly mounted to the container 10.

A turntable 19 connects the frame 14 to the support block 18. This turntable 19 includes two 90° detents which ensure that the frame 14 can be positioned in only two rotational positions, i.e. the storage position shown in FIG. 2 and the operational position shown in FIG. 4.

As best shown in FIGS. 2 and 3, the frame 14 is thus pivotal between a storage position, illustrated in FIG. 2, and an operational position, illustrated in FIG. 3. In its storage position (FIG. 2) the frame 14 is nested closely adjacent the container 10. Preferably, in its storage position, a door 20 (FIG. 1) on the container 10 covers the lift mechanism 12 and protects it from unintentional damage. Conversely, in its operational position (FIG. 3) the frame 14 protrudes laterally outwardly from the container 10.

Still referring to FIGS. 2 and 3, an elongated cylinder and piston assembly 22 is secured to the frame 14 so that the axis of the cylinder and piston assembly 22 extends generally vertically. The cylinder and piston assembly 22 includes a cylinder 24 secured to the frame 14 and a piston 26 which extends telescopically longitudinally outwardly from its cylinder 24 when powered foot 28 is secured to the lower or free end of the piston 26.

Figure 4:
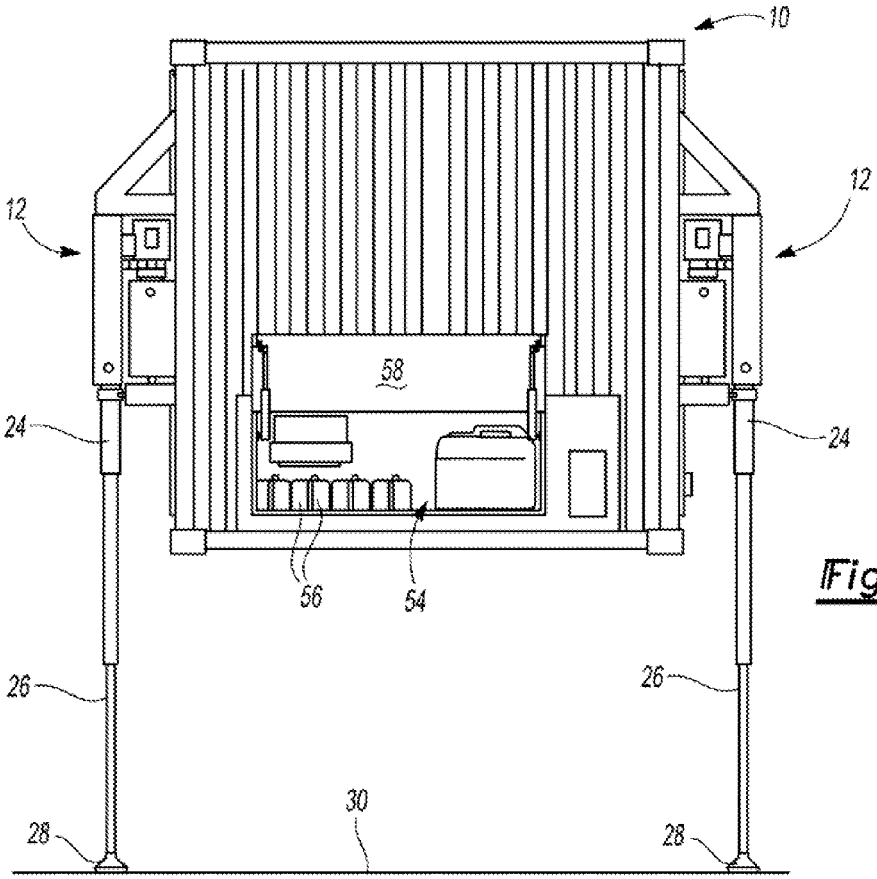
FIG. 4 is an end view of the container with the lift mechanisms in their operational position and the container in an elevated position.
Figure 5:
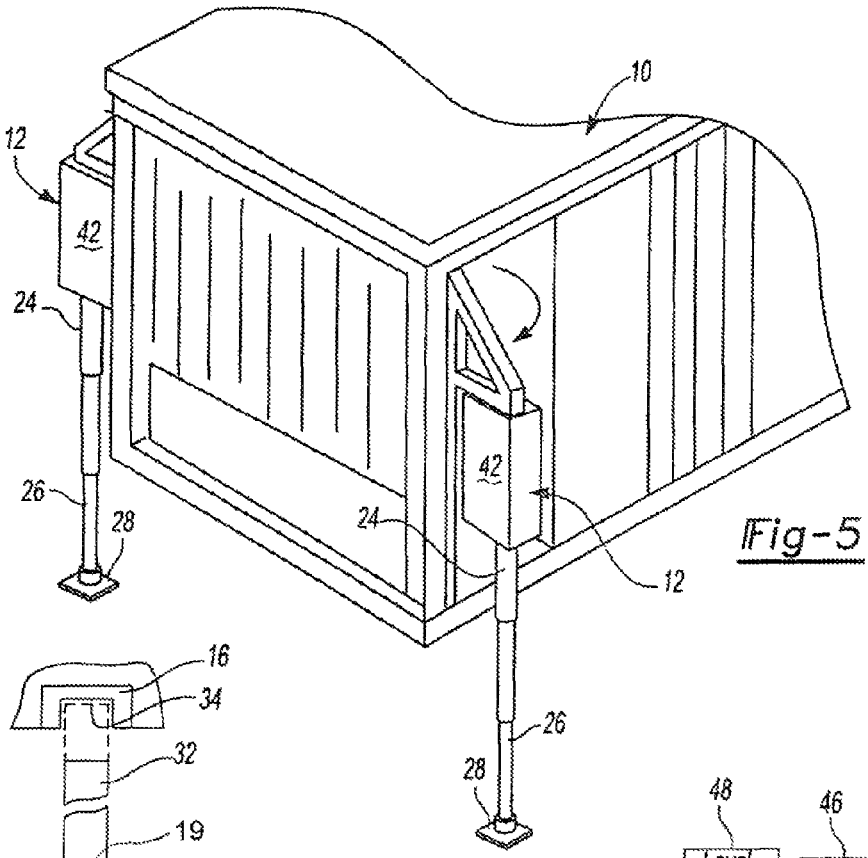
FIG. 5 is an elevational view illustrating the container in an elevated position.

As best shown in FIGS. 3-5, with the lift mechanisms 12 in their operational position, the application of power to the cylinder and piston assemblies 22 causes the pistons 26 to telescope downwardly so that the foot 28 engages and lifts the container 10 upwardly from a ground supporting surface 30. Conversely, the container may be lowered by selectively retracting the pistons 26 within their associated cylinders 24.

An electrical control system 54, including storage batteries 56, is contained within a compartment 58 in the container 10. The batteries 56 may also be charged by shore power, portable generator, or by the electrical system of a transport vehicle to enable the container to be functional as a laboratory, command center, or hospital immediately upon delivery.

Figure 7:
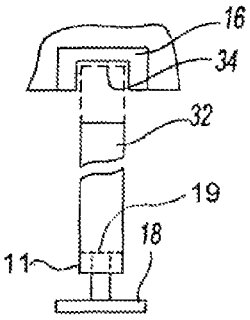
FIG. 7 is a fragmenting view illustrating a portion of the frame.

With reference now particularly to FIG. 7, phantom line with the frame 14 in its operational position the frame 14 is vertically slidably mounted between an upper position, illustrated in a lower position, illustrated in solid line. When the frame 14 is in its operational position, a top 32 of the frame 14 registers with a like shaped recess 34 formed in the upper support mount 16. Thus, as the pistons 26 extend downwardly, the frame 14 lifts upwardly until its upper end 32 is nested within the recess 34. The recess 34 as well as the upper end 32 of the frame 14 are noncircular in shape so that the coaction between the frame 14 and the recess 34 locks the frame 14 against pivotal movement when the frame 14 is in its operational position and the container is elevated. Conversely, when the pistons 26 are retracted into their cylinder, the weight of the frame 14 causes the frame 14 to move downwardly which allows the frame 14 to pivot to its storage position illustrated in FIG. 2.

Figure 6:
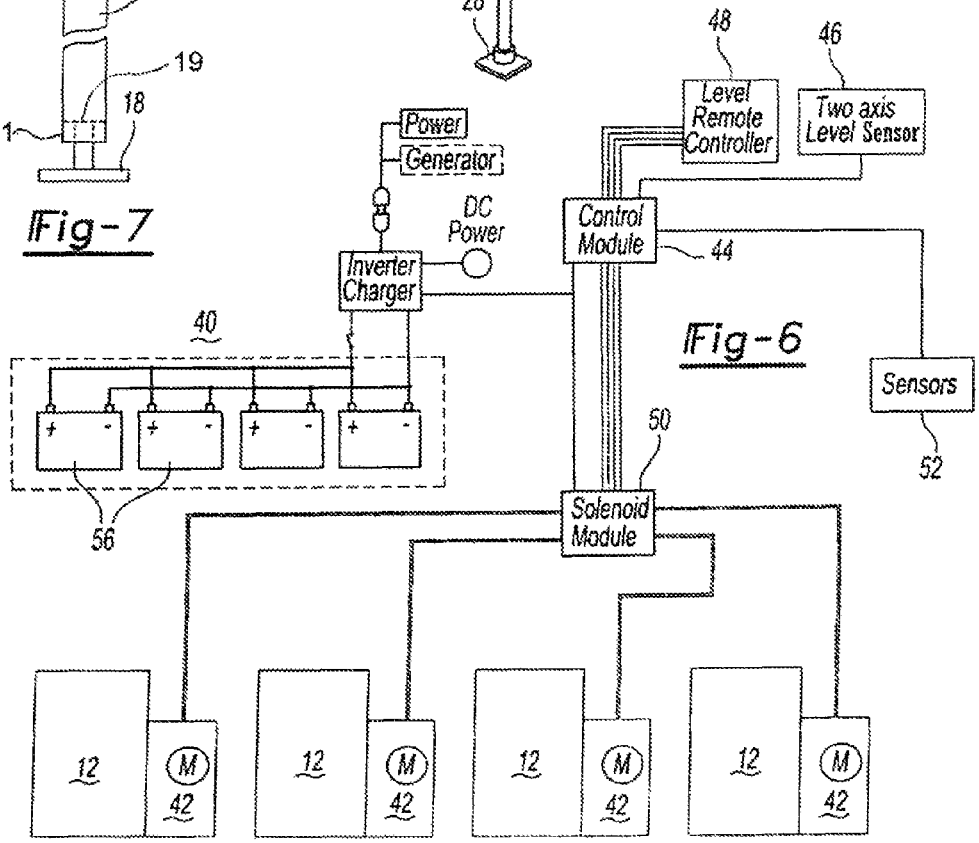
FIG. 6 is a schematic view illustrating the electric control system of the present invention.

Preferably, the cylinder and piston assemblies 22 are hydraulic cylinder and piston assemblies and a control circuit 40 illustrated in FIG. 6 selectively controls the application of power to the various hydraulic power units 42 and piston assemblies 22. However, other types of cylinder and piston assemblies, such as electric motor driven cylinder and piston assemblies, or a centralized hydraulic power unit that provides hydraulic fluid to each individual cylinder and piston assembly, may alternatively be employed without deviation from the spirit or scope of the invention.

With reference now to FIGS. 2 and 6, a hydraulic power unit 42 is associated with each lift mechanism 12 to selectively extend or retract the piston relative to its associated cylinder 24. The control circuit 40 includes a control module 44 which receives as an input signal a signal from a two axis level sensor 46. In response to the signal from the two axis level sensor 46, as well as a control panel 48 which a user utilizes to select the desired operation, the control module 44 controls the actuation of the hydraulic power units 42 through a solenoid module 50.

In operation, in order to move the cargo container upwardly to a load position relative to the ground support surface, the frame 14 with their associated cylinder and piston assemblies 22 are first pivoted outwardly to their operational position and so that the detent 11 (FIG. 7) for the turntable 19 "locks" the frame 14 in the operational position. The control panel 48, which may be remote from the container, is then utilized to select a lift operation. The control module 44 then activates the power units 42 for the lift mechanisms.

However, in order to prevent actuation of the power unit unless all frames 14 are positioned in their operational position, a sensor 52 (FIG. 2) is associated with each frame and provides an output signal to the control module 44 (FIG. 6) only when its associated frame is in its operational position. Unless all four sensors 52 provide the signal to the control module 44, the control module 44 disables all power units.

Upon the initial extension of the piston 26 from its associated cylinder 24, the cylinder and piston assembly 22 first moves the frame 14 upwardly so that it upper end 32 engages the locking recess 34 on the upper support 16 to prevent further pivoting of the frame 14 as shown in phantom line in FIG. 7. Thereafter, the control module 44 activates all power units 42 which moves the cargo container to its elevated position illustrated in FIG. 4. This allows a flatbed truck to be driven underneath the cargo container. Thereafter, the control panel 48 is activated to lower the cargo container onto the flatbed truck by retracting the pistons 26 into their associated cylinders 24. When fully retracted, the frame 14 for each lift mechanism 12 slides vertically downwardly due to its own weight whereupon the frames 14 with their attached cylinder and piston assemblies 22 can be pivoted to their storage position and the doors 20 closed.

If leveling is required, after pressing the level button in the level remote controller 48 the control module 44 then selectively operates the power units 42 in response to the signal from the two axis level sensor 46 until the container 10 is in a level position. Such leveling would be desirable, for example, if the container was used as a laboratory or mobile hospital.

From the foregoing, it can be seen that the present invention provides a simple yet effective mechanism for elevating and lowering a cargo container. Having described our invention, however, many modifications thereto will become apparent to those of skill in the art to which it pertains without deviation from the spirit of the invention as defined by the scope of the appended claims.

NUMBER KEY

10 container
12 lift mechanism
14 frame
16 upper support block
18 lower support block
19 turntable
20 door
22 cylinder and piston assembly
24 cylinder
26 piston
28 foot
30 ground support surface
32 top
34 recess
40 control circuit
42 power unit
44 control module
46 level switch
48 control panel
50 solenoid module
52 Sensor
54 electrical system
56 batteries
58 compartment

The invention claimed is:

1. A system for vertically lifting and lowering a container relative to a supporting surface, comprising:

at least two lift mechanisms, each of said lift mechanisms having a frame attached to the container;

an elongated cylinder and piston associated with each frame, said cylinder being attached to its associated frame and a foot attached to said piston, a longitudinal axis of each cylinder and piston being substantially vertically oriented, wherein each frame is pivotally attached between an upper and a lower support block on the container about a vertical axis between a storage position in which its associated piston and cylinder nests closely adjacent the container and an operational position in which its associated piston and cylinder is spaced outwardly from the container, and wherein each said frame is vertically slidably mounted to the container between an upper and a lower position and wherein, with said frame in said upper position, a portion of said frame is received within a locking recess on the upper support block which locks said frame against pivotal movement;

a power source selectively connected to each piston and cylinder; and a control circuit which controls the connection of said power source to each cylinder and piston to move said piston between a retracted position in which said piston is spaced upwardly from the supporting surface and an extended position in which said foot engages the supporting surface and lifts the container upwardly from the supporting surface.

2. The system as defined in claim 1, wherein each of said cylinder and piston comprises a hydraulic cylinder and piston and wherein said power source comprises a source of hydraulic fluid.

3. The system as defined in claim 1, further comprising a control panel which controls the operation of the control circuit.

4. The system as defined in claim 1, wherein the container is generally rectangular in shape and wherein one of said at least two lift mechanisms is attached to the container adjacent each corner of the container.

5. The system as defined in claim 1, further comprising a level sensor attached to the container which is electrically connected to the control circuit.

6. The system as defined in claim 5, wherein said level sensor is a two axis level sensor.

7. The system as defined in claim 5, wherein said control circuit, in response to a signal from said level sensor, selectively powers said cylinder and pistons on said lift mechanisms to bring the container to a level position.

8. The system as defined in claim 1, further comprising a switch associated with each frame which provides a signal to said control circuit only when its associated frame is in said operational position, said control circuit connecting power to said cylinders only when all frames are in said operational position.

9. The system as defined in claim 1, wherein each said frame is mounted to the container by a turntable, said turntable having two detents which lock said frame to the container at only said storage and operational positions, so that said frame can be moved between storage and operational positions but only locked into position in one of said storage and operational positions.

* * * * *